US005225145A

United States Patent [19]

Winch

[11] Patent Number: 5,225,145

[45] Date of Patent: Jul. 6, 1993

[54] APPARATUS FOR OPENING AND CLOSING A TAPHOLE OF A METALLURGICAL FURNACE

[75] Inventor: Reginald W. Winch, Sault Ste. Marie, Canada

[73] Assignee: Hoogovens Technical Services Canada, Inc., Burlington, Canada

[21] Appl. No.: 883,450

[22] Filed: May 15, 1992

[51] Int. Cl.[5] ..... C21C 5/48

[52] U.S. Cl. ..... 266/273; 266/271

[58] Field of Search ..... 266/271, 272, 273, 45

[56] References Cited

U.S. PATENT DOCUMENTS

| | | | |
|---|---|---|---|
| 3,549,141 | 12/1970 | Zimmerman | 266/273 |
| 3,667,748 | 6/1972 | Dienenthal et al. | 266/273 |
| 4,195,825 | 4/1980 | Ulveling et al. | 266/273 |

FOREIGN PATENT DOCUMENTS

| | | | |
|---|---|---|---|
| 0856609 | 12/1960 | United Kingdom | 266/271 |

*Primary Examiner*—Scott Kastler

*Attorney, Agent, or Firm*—Stevens, Davis, Miller & Mosher

[57] ABSTRACT

An improved apparatus for opening and closing a taphole of a metallurgical furnace includes stationary pedestal sections carrying an upper boom and a lower boom which booms can be slewed by driving means independently from each other with one of their ends around the pedestal. To one of the booms a drilling machine is connected and to the other a taphole-plugging machine. The swing paths of the booms are inclined relative to each other, such that the two machines can be swung into parked positions, at heights suitable for operations and maintenance, and each into its servicing position in front of the taphole. Preferably, the drilling machine is connected to the upper boom. Also preferably, the connection between each boom and the pedestal is accomplished by two vertically separated large diameter slewing bearings, and by driving means consisting of two hydraulic cylinders. The inclination of the axis of rotation of the two booms, in the vertical plane of the taphole, will be determined for each installation, from the relevant heights of the operating and parking required locations of the drilling and plugging machines. The inclination of the axis of rotation normal to the above plane for each boom will also be determined for each installation by the clearance necessary as the upper boom assembly passes over the lower boom. The preferred angles of inclination to give satisfactory elevations and clearances are for the upper boom between 0 and 2 degrees towards the taphole plane and between 8 and 10 degrees towards the furnace in the plane normal to the above. For the lower boom, the angles are between 4 and 6 degrees away from the plane of the taphole and between 2 and 4 degrees towards the furnace.

6 Claims, 7 Drawing Sheets

PEDESTAL KEY PLAN

APPARATUS FOR OPENING AND CLOSING A TAPHOLE OF A METALLURGICAL FURNACE

BACKGROUND OF THE INVENTION i) Field of the Present Invention

The present invention relates generally to metal making apparatus, and more particularly to apparatus for opening and closing a taphole of a metallurgical furnace.

ii) Description of the Prior Art

In the making of molten metal in a metallurgical furnace, such as pig-iron in a blast furnace, the molten metal usually is tapped from the furnace through one or more tapholes. While the furnace is in the operation of metal making the taphole(s) should be closed.

A usual way of closing the taphole consists in filling it with refractory clay after each tapping operation. For that purpose plugging machines have been developed which are generally known and used in the art of iron making. In its servicing position such a plugging machine is moved in front of the taphole to be closed and thereupon injects refractory clay of a suitable composition under pressure into the taphole until it is closed, whereupon the plugging machine is moved away into a parked position.

Also a usual way of opening the taphole consists of drilling a hole through the refractory clay previously injected by the plugging machine. Suitable drilling machines are generally known and used in the art of iron making. In its servicing position the drilling machine is moved in front of the taphole to be drilled. After drilling the drilling machine is moved away into a parked position.

According to the known art the drilling machine and the plugging machine are separately floor mounted, either both on one side or on both sides sideways in front of the taphole.

In both cases, large areas of the cast house floor are required to accommodate the necessary swing paths of the drilling and plugging machines.

As mechanisation of the furnace operation is becoming increasingly evident, cast house floor is at a premium. In that situation the known apparatus is at a disadvantage, since the swing path areas of the drilling and plugging machines occupy too much of the available space. This holds especially for existing blast furnace plants where additional space is required in the taphole area for modernizing the furnaces by adding for instance fume extraction equipment, tilting runners, iron trough cover removal structures etc.

SUMMARY OF THE PRESENT INVENTION

The present invention overcomes the above-mentioned disadvantages by providing improved apparatus of the known art which further comprises a stationary pedestal carrying an upper boom and a lower boom, both booms being mounted for independent slewing movements with one of their ends around the pedestal, driving means connected to each of the booms for performing the slewing movements, a drilling machine connected at an angle to the free end of one of the booms, and a plugging machine connected at an angle to the free end of the other boom; wherein the swing paths of the upper and the lower booms are slightly inclined with respect to each other resulting in swing paths in which the drilling and plugging machines can be freely moved to parked positions away from the taphole, at heights suitable for operations and maintenance, and in which each of these machines can be moved separately into its servicing position in front of the taphole. As a result of this improvement the swing paths of the drilling and plugging machines for a major part almost coincide, which results in a reduction of the required swing path area which may amount up to 50% of the areas generally used. Especially if for modernizing purposes additional equipment is to be installed this saving in available space is of paramount importance.

Preferably, the connection of the supported end of each boom to the pedestal is achieved by using two vertically separated large diameter slewing bearings, whereas as driving means for the booms two hydraulic cylinders are enclosed within each boom. These cylinders are connected to that boom at one of their ends and to the pedestal at their other ends, allowing for a swing path of up to 160 degrees of that boom when hydraulic pressure is applied and /or released. The large diameter slewing bearings are very suitable for being designed to withstand the very large forces required to hold the drilling and plugging machines against the taphole resisting the drilling and plugging operations. Also they allow for an accurate inclined mounting at angles which determine the inclination of the swing paths of the two booms. The angles of the slewing bearings are critical in establishing the drilling and plugging angles in conjunction with the parking and servicing locations.

The use of the hydraulic cylinders for moving the booms is advantageous over the use of other possible driving means in that they allow for a fast single motion from the parked position to the servicing position. This results in extremely fast operation in removing the drill from the hot metal stream or stopping the taphole with the plugging machine. The geometry of the novel slewing mechanism can also be designed such that maximum torque is available at the end of the slewing in stroke at the same time as the velocity is at a minimum. This ensures maximum holding force against the furnace and minimum impact at the taphole for both drilling and plugging machines. When slewing "out", i.e. towards the parked position, maximum acceleration is available at the beginning of the stroke where it is vital that the drilling machine is removed from the hot metal stream as fast as possible.

The best adaption of the inclined swing paths to the required drilling and plugging angles is achieved according to the present invention by connecting the drilling machine to the upper boom. A compact configuration is further achieved with the present invention if the pedestal is positioned sideways in front of the taphole, whereby the axis of rotation of the upper boom is inclined towards the furnace by between 8 and 10 degrees and is inclined towards the vertical plane comprising the taphole axis by between 0 and 2 degrees, and whereby the axis of rotation of the lower boom is inclined towards the furnace by between 2 and 4 degrees and is inclined away from the said vertical plane by between 4 and 6 degrees.

Basically, the pedestal is designed as to comprise the two pairs of vertically spaced large diameter slewing bearings which may be supported by intermediate ring-shaped elements. In order to further improve the stability of this construction, the invention also provides for a column which is positioned next to the pedestal outside the swing paths of the booms. This column resists the torsional and shear forces from the fixed rings of the three uppermost of the slewing bearings. A further advantage of the column is that it also serves as a conduit for hydraulic piping to the hydraulic cylinders in the upper boom.

BRIEF DESCRIPTION OF THE DRAWINGS

The present invention will be more clearly understood by reference to the following detailed description of a preferred embodiment when read in conjunction with the accompanying drawings in which like reference characters refer to like parts throughout the views and in which.

DETAILED DESCRIPTION OF A PREFERRED EMBODIMENT

Figure 1:
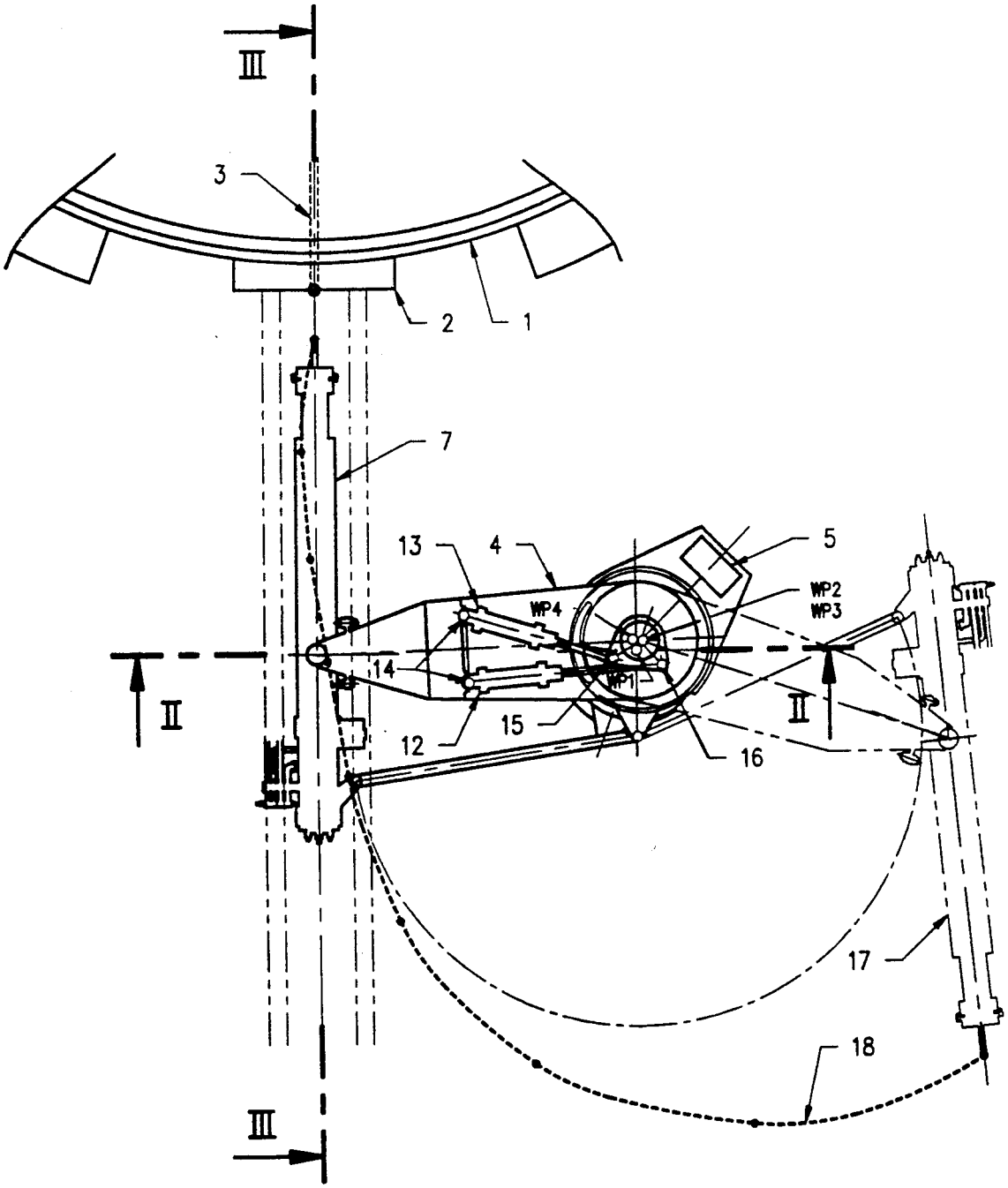
FIG. 1 is a plan view of the apparatus in accordance with the present invention, in which the plugging machine has been omitted, and with a schematic indication of the taphole area or a blast furnace.
Figure 2:
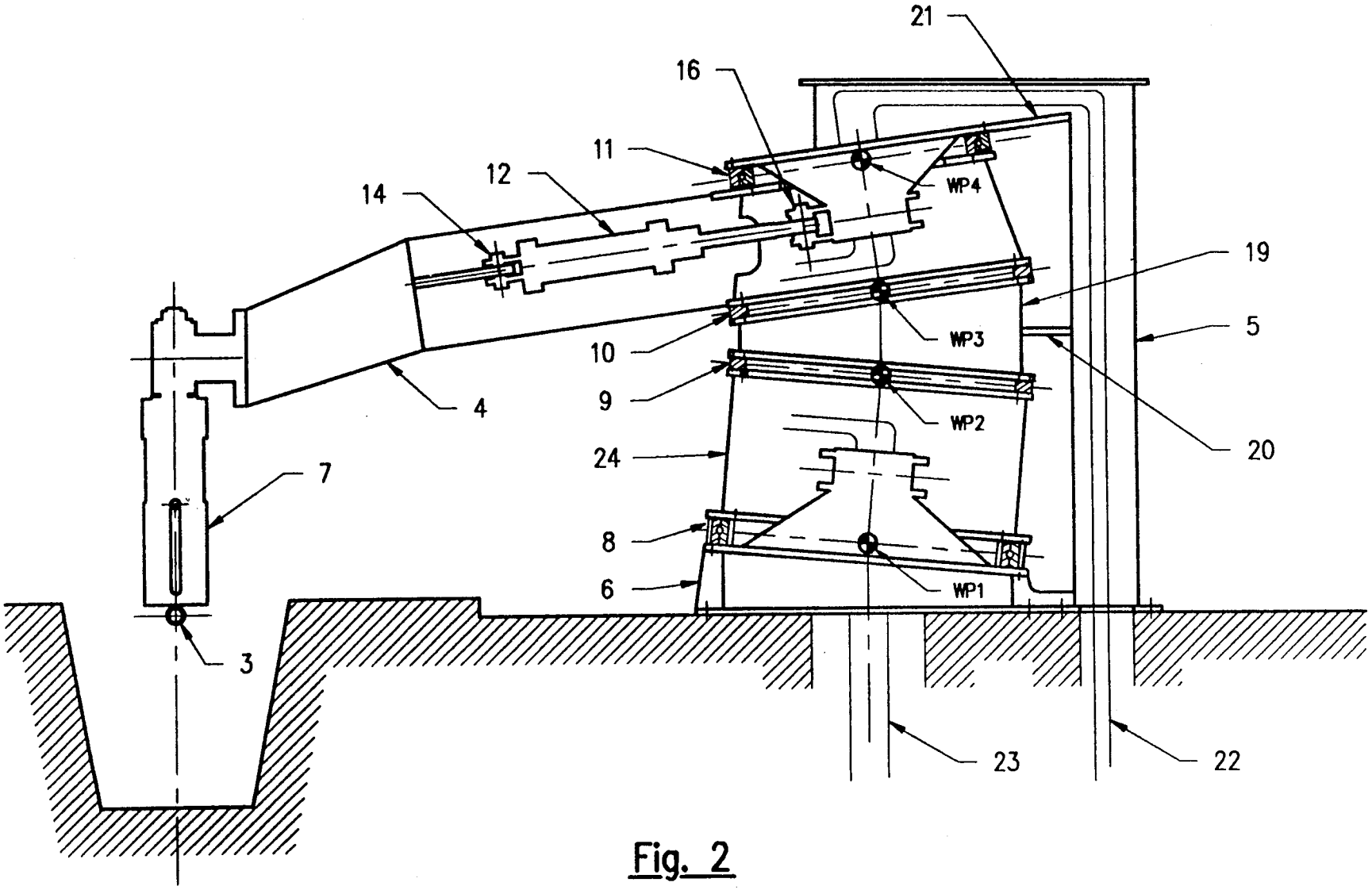
FIG. 2 is a view, partly in section, taken substantially along the line II—II in FIG. 1.
Figure 3:
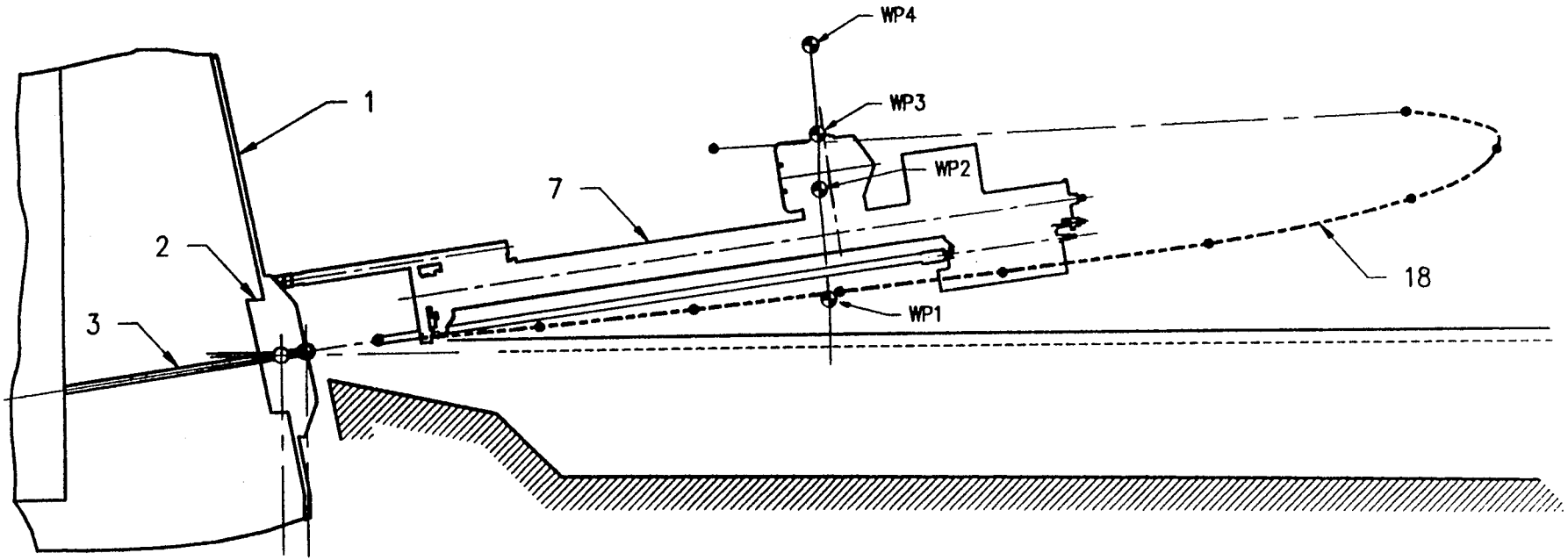
FIG. 3 is a partial view, taken substantially along the line III—III in FIG. 1.

Referring first to FIG. 1 and FIG. 2, a section of a furnace wall 1 is shown, with schematically the taphole section 2 and the taphole 3, FIG. 3 shows these details in longitudinal section. A boom 4 is arranged next to a column 5 and with one end rotatable around ringshaped element 19 (see FIG. 2) which forms part of the pedestal. Boom 4 carries at its other end a drilling machine 7, which has been shown in its servicing position opposite the taphole 3 in drawn lines. By slewing the boom 4 the drilling machine 7 is moved to the parked position 17 indicated in dotted lines. The path of the drill tip in retracted position is indicated in FIG. 1 and FIG. 3 by dotted line 18.

Referring now to FIG. 2, four large diameter slewing bearings 8–II are shown, of which bearings 10 and 11 connect boom 4 to ringshaped element 19 and column plate 21. In a similar way bearings 8 and 9 connect boom 24 (see FIG. 6) to ringshaped element 19 and pedestal base 6. The fixed ring of bearing 8 is connected to the foundation 6 of the pedestal. The fixed rings of bearings 9 and 10 are connected by ringshaped element 19 and plate 20 to column 5, and the fixed ring of bearing 11 is connected to column 5 by means of plate 21.

Boom 4 is further connected to column plate 21 by means of hydraulic cylinders 12 and 13 (see FIG. 1). At one end these cylinders are connected to boom 4 at points 14, at their other ends they are connected to fixed points 15 and 16 of the pedestal.

As shown in FIG. 2 the bearings 8 and 9 are coaxial and their axis is inclined with respect to the vertical. Bearings 10 and 11 also are coaxial, but their axis is inclined in a different direction with respect to the vertical. FIGS. 1 and 2 show the shifted position of the centers WP1–4 of bearings 8–11.

Figure 4:
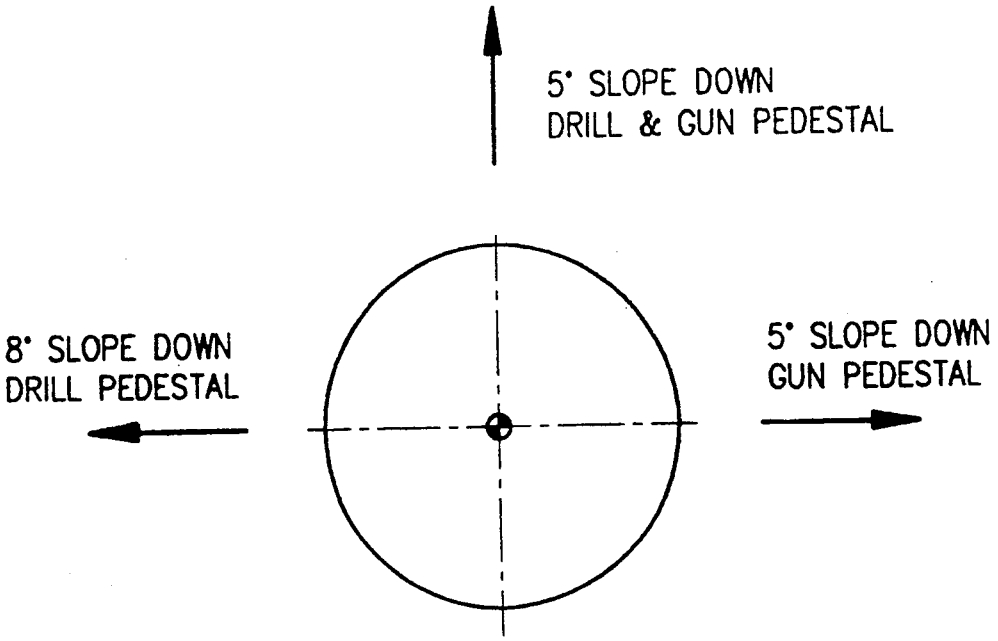
FIG. 4 is a key plan showing, as an example, the slopes of the various bearings in the pedestal.

In FIG. 4 the inclinations of the axes of the bearings are shown schematically in a key plan, also showing the amounts of the components of the slope in two directions numerically.

FIG. 2 further shows by numeral 22 the hydraulic piping through column 5 and leading to hydraulic cylinders 12 and 13. Similarly hydraulic piping centrally through bearing 8 serves the hydraulic cylinders in boom 24.

Figure 5:
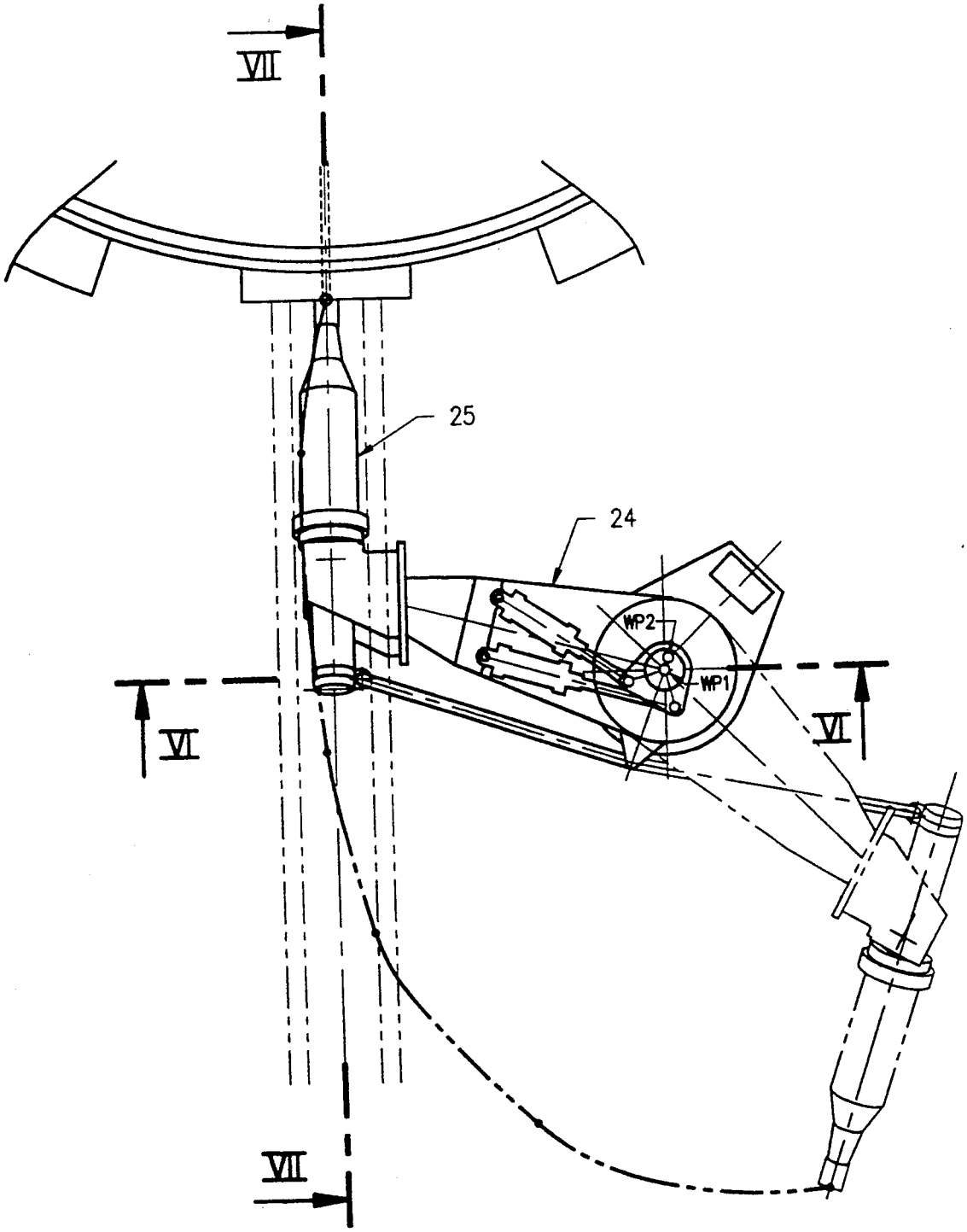
FIG. 5 is a plan view similar to that of FIG. 1, in which, however, the plugging machine has been shown and the drilling machine has been omitted.
Figure 6:
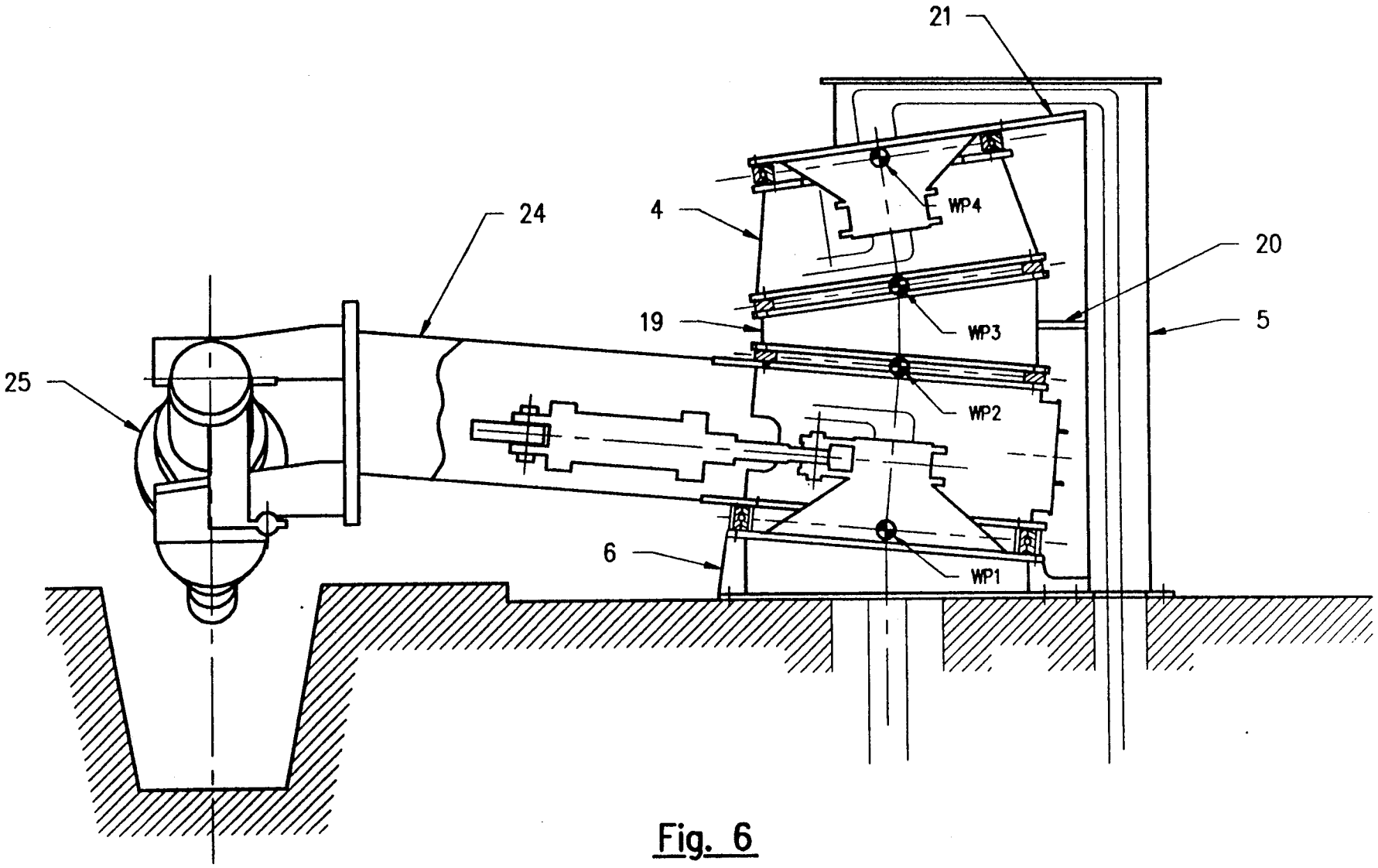
FIG. 6 is a view, partly in section, taken substantially along the line VI—VI in FIG. 5.
Figure 7:
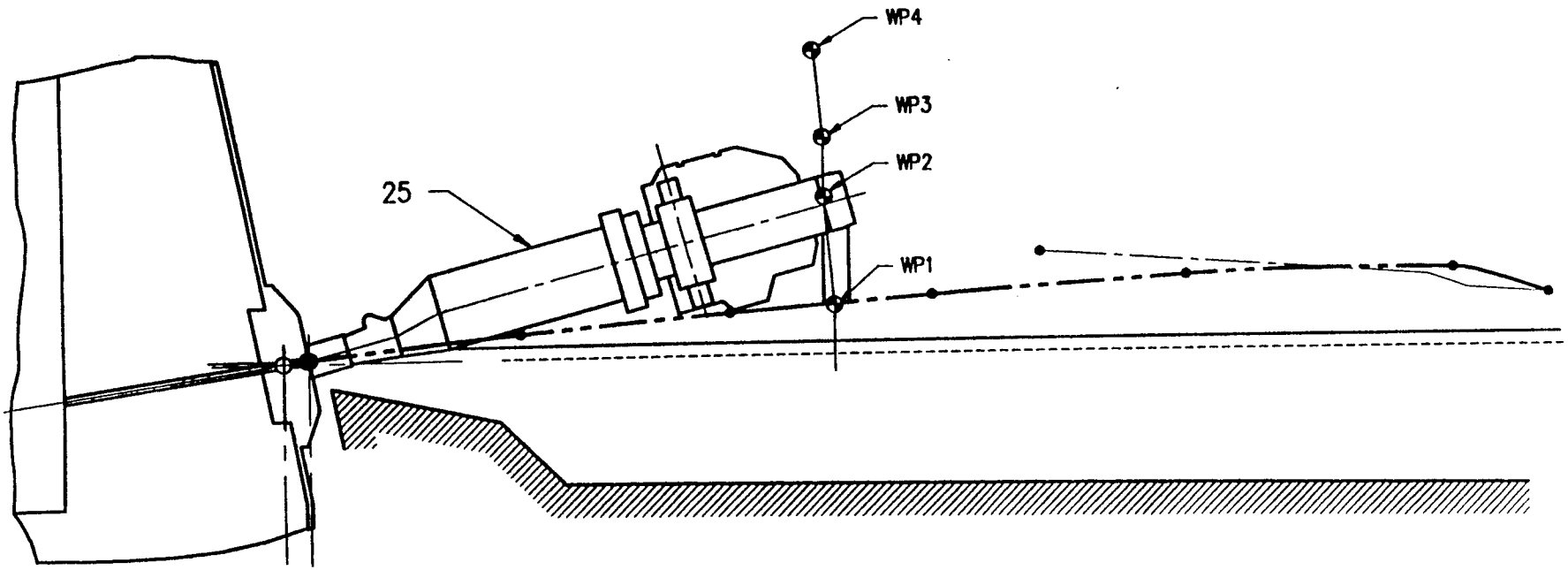
FIG. 7 is a partial view, taken substantially along the line VII—VII in FIG. 5.

FIGS. 5, 6 and 7 are similar to FIGS. 1, 2 and 3. Instead of boom 4, boom 24 is shown with gunning machine 25 at its free end. A detailed description of these figures is superfluous because of the similarity with FIGS. 1, 2 and 3. It is clear that in their servicing positions both the drilling and the gunning machines are positioned in front of the taphole, and that in their parked positions the drilling machine is adjacent to, and at a similar height to, the gunning machine.

Having thus described the present invention, many modifications thereto will become apparent to those skilled in the art to which it pertains without departing from the scope and spirit of the present invention as defined in the appending claims.

I claim:

1. Apparatus for opening and closing a taphole of a metallurgical furnace comprising:

a stationary pedestal carrying an upper boom and a lower boom, both booms being mounted for independent slewing movements with one of their ends around the pedestal, driving means connected to each of the booms for performing the slewing movements, a drilling machine connected at an angle to the free end of one of the booms, and a plugging machine connected at an angle to the free end of the other boom;

wherein the swing paths of the upper and the lower booms are slightly inclined with respect to each other resulting in swing paths in which the drilling and plugging machines can be freely moved to parked positions away from the taphole, at heights suitable for operations and maintenance, and in which each of these machines can be moved separately into its servicing position in front of the taphole.

2. Apparatus as described in claim 1 wherein the supported end of each boom is connected to the pedestal for a slewing movement by two vertically separated large diameter slewing bearings.

3. Apparatus as described in claim 1 wherein as driving means two hydraulic cylinders are enclosed within each boom, connected to that boom at one of their ends and to the pedestal at their other ends, allowing for a swing path of up to 160 degrees of that boom when hydraulic pressure is applied and/or released.

4. Apparatus as described in claim 1, wherein the drilling machine is connected to the upper boom and the plugging machine to the lower boom.

5. Apparatus as described in claim 1, wherein the pedestal is positioned sideways in front of the taphole, wherein the axis of rotation of the upper boom is inclined towards the furnace by between 8 and 10 degrees and is inclined towards the vertical plane comprising the taphole axis by between 0 and 2 degrees, and wherein the axis of rotation of the lower boom is inclined towards the furnace by between 2 and 4 degrees and away from the said vertical plane by between 4 and 6 degrees.

6. Apparatus as described in claim 3, wherein a column is positioned next to the pedestal outside the swing paths of the booms, said column resisting the torsional and shear forces from the fixed rings of the three uppermost of the large diameter slewing bearings, and further serving as a conduit for hydraulic piping to the hydraulic cylinders in the upper boom.

* * * * *